US008087257B2

(12) United States Patent
Kim et al.

(10) Patent No.: US 8,087,257 B2
(45) Date of Patent: Jan. 3, 2012

(54) AIR CONDITIONER INTEGRATED MANAGEMENT SYSTEM AND CONTROL METHOD OF THE SAME

(75) Inventors: Jun Tae Kim, Seoul (KR); Sang Chul Youn, Seoul (KR); Duck Gu Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 1127 days.

(21) Appl. No.: 11/618,334

(22) Filed: Dec. 29, 2006

(65) Prior Publication Data

US 2007/0157644 A1 Jul. 12, 2007

(30) Foreign Application Priority Data

Dec. 31, 2005 (KR) ..... 10-2005-0136306

(51) Int. Cl.

| | |
|---|---|
| ***G01K 13/00*** | (2006.01) |
| ***G05D 23/32*** | (2006.01) |
| ***F25D 29/00*** | (2006.01) |
| ***F25B 49/00*** | (2006.01) |

(52) U.S. Cl. ..... 62/129; 62/127; 62/161; 700/276

(58) Field of Classification Search ..... 62/129, 62/157, 158, 161, 127; 236/51; 700/276, 700/299, 300; 714/27, 43

See application file for complete search history.

(56) References Cited

U.S. PATENT DOCUMENTS

| | | | | |
|---|---|---|---|---|
| 5,853,123 | A | 12/1998 | Okano | |
| 2001/0048376 | A1 * | 12/2001 | Maeda et al. | 340/870.17 |
| 2003/0226065 | A1 * | 12/2003 | Shingaki | 714/43 |
| 2004/0117069 | A1 * | 6/2004 | Yoon et al. | 700/276 |
| 2004/0139371 | A1 * | 7/2004 | Wilson et al. | 714/43 |
| 2005/0097902 | A1 | 5/2005 | Kwon | |

FOREIGN PATENT DOCUMENTS

| | | |
|---|---|---|
| EP | 1 426 703 | 6/2004 |
| EP | 1 719 957 | 11/2006 |
| GB | 2 257 538 | 1/1993 |

OTHER PUBLICATIONS

European Search Report dated May 3, 2007, European Application No. 06027106.1, 7 pages).

* cited by examiner

*Primary Examiner* — Ljiljana(Lil) V. Ciric
*Assistant Examiner* — Travis Ruby
(74) *Attorney, Agent, or Firm* — Fish & Richardson P.C.

(57) ABSTRACT

Disclosed are an air conditioner integrated management system and an operational method of the same according to the present invention. The present invention can promptly detect and repair the device, where an error really occurred, by determining the error as an upper unit's in the case that the error occurred at the whole devices belonging to a lower unit managed by the upper unit.

10 Claims, 5 Drawing Sheets

AIR CONDITIONER INTEGRATED MANAGEMENT SYSTEM AND CONTROL METHOD OF THE SAME

This Nonprovisional application claims priority under 35 U.S.C. §119(a) on Patent Application No. 10-2005-0136306 filed in Korea on Dec. 31, 2005, the entire contents of which are hereby incorporated by reference.

BACKGROUND OF THE DISCLOSURE

1. Field of the Disclosure

The present invention relates to an air conditioner integrated management system and a control method of the same, and more specifically, to an air conditioner integrated management system comprising a lower unit including a plurality of indoor units, an upper unit connected to the lower unit over a network to manage and control the lower unit, and an integrated data server connected to the upper unit over the network to check up the state of the upper unit and lower unit, and a control method of the same.

2. Description of the Background Art

In general, an air conditioner is an appliance for indoor cooling. The air conditioner causes the heat exchange between a given coolant and the surrounding air by compressing, vaporizing, and condensing the refrigerant to cool air, and discharges the cooled air into a room by a fan.

In recent years, an air conditioner capable of indoor heating as well as indoor cooling has widely pervaded, which implements the heating function by applying the above cycle in a reverse manner, i.e. in the order of condensing, vaporizing, and compressing the coolant, and thus the air conditioner has been used as an appliance for indoor air conditioning all season.

A building having a plurality of independent indoor spaces uses a multi air conditioning system, which includes a plurality of indoor units and an outdoor unit, each indoor unit is separately installed at each independent indoor space and the outdoor unit is shared by the plurality of indoor units to control the flow of the coolant.

The multi air conditioning system includes at least two indoor units and an outdoor unit as the minimum unit, the outdoor unit is shared by and connected to each of the indoor units. A large scale building such as a school building, a company building, and so forth includes the minimum unit of the multi air conditioning system in plurality, and hence further includes a local controller shared by and connected to the plurality of outdoor units.

In this case, considering the plurality of indoor units as a lower unit, the outdoor units can be relatively treated as an upper unit, and considering the plurality of outdoor units as a lower unit, the local controller can be relatively treated as an upper unit Conventionally, this upper unit has carried out maintenance by continuing to collect the driving information of the lower unit, and thus has had a problem that in the case that an error occurs at the upper unit, the upper unit doesn't determine the error as its own but as the lower unit's thereby to stop the operation.

In the case, for example, that the lower unit includes a plurality of indoor units and an error occurs at an outdoor unit controlling and managing the lower unit, the upper unit determines the error occurred at least one of the indoor units constituting the lower unit even when each indoor unit operates normally.

As such, the upper unit could not perform self diagnosis in the case that an error occurred, and thus should unnecessarily inspect the whole lower units subordinate thereto, thus having resulted in the increase of costs for restoring the error.

SUMMARY OF THE DISCLOSURE

An air conditioner integrated management system and a control method of the same according to the present invention, can reduce time and costs required to restore the error since the upper unit can perform self error diagnosis.

An air conditioner integrated management system according to the present invention comprises: a lower unit including at least one indoor unit; an upper unit connected to the lower unit over a network to perform the operation control; and a topmost unit connected to the upper unit over a network to receive system information of the upper unit and the lower unit, wherein the upper unit senses its own error state and an error state of the subordinate lower unit to transmit error state information to the topmost unit.

The upper unit may be an outdoor unit connected to the at least one indoor unit, or a gateway connected to the at least one outdoor unit over a network to relay communication.

The topmost unit may be an external integrated data server connected over a network.

The upper unit may collect an error generated in the at least one indoor unit belonging to the subordinate lower unit in a log data type and generates error state information, and in a case where an error occurs at the lower unit subordinate to the upper unit, the upper unit may determine the error as its own and generate error state information.

A method of operating an air conditioner integrated management system according to the present invention comprising: a lower unit including at least one indoor unit; an upper unit connected to the lower unit over a network to perform the operation control; and a topmost unit connected to the upper unit over a network to perform the integrated control, comprises: sensing an error occurred at the lower unit; in a case where an error occurs at all devices belonging to a lower unit, determining the error as an upper unit's own error, the upper unit connected to the lower unit; transmitting error state information generated from the lower unit and the upper unit to the topmost unit.

DETAILED DESCRIPTION OF EMBODIMENTS

Hereafter, embodiments of the present invention will be described in more detail with reference to FIGS. 1 to 5.

Figure 1:
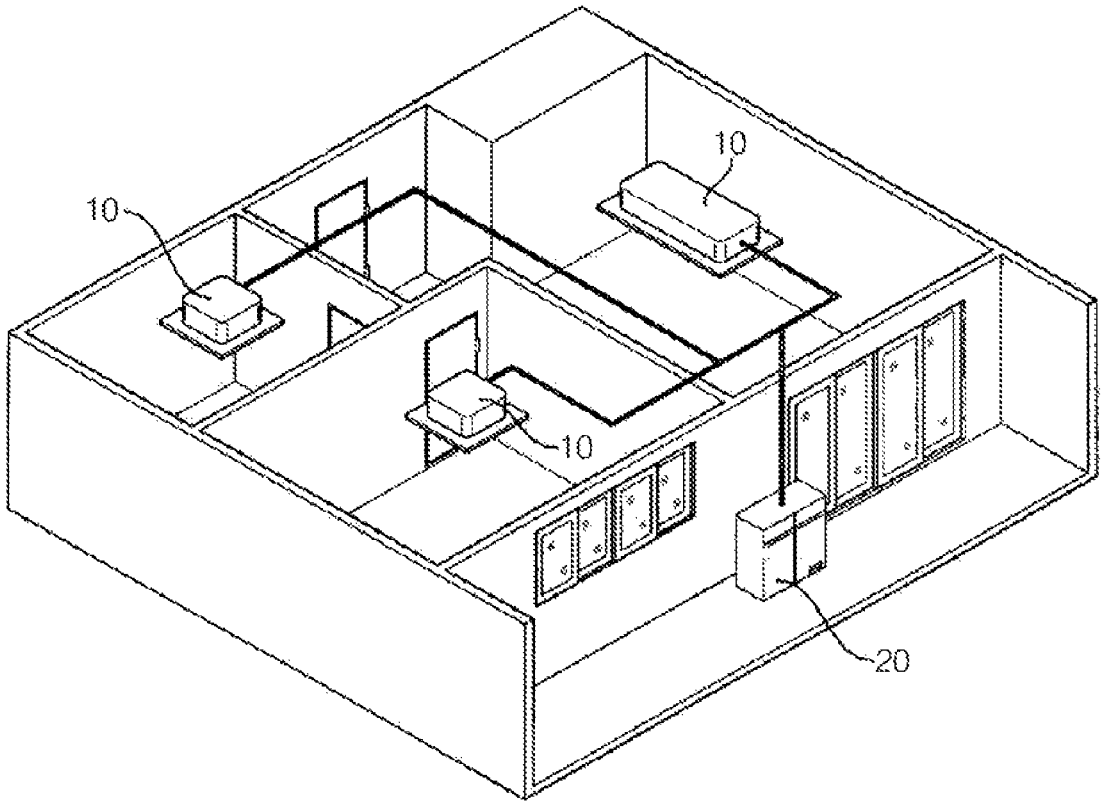
FIG. 1 is a constructional view of a multi air conditioning system according to the present invention.

FIG. 1 is a constructional view of a multi air conditioning system according to the present invention. The multi air conditioning system according to the present invention includes a plurality of indoor units 10 and an outdoor unit 20 shared by and connected to the plurality of indoor units. The outdoor unit 20 distributes a coolant and controls the circulation of the coolant.

In addition, the outdoor unit 20 calculates open and close degree of an expansion valve of the indoor units according to a control command to the number of rotations of a compressor in the outdoor unit so that the appropriate amount of coolant can be circulated. For this purpose, the outdoor unit 20 should monitor the operation of the indoor units in real time. Therefore, the outdoor unit 20 is connected to the indoor units in a serial communication manner and transmits and receives data to/from the indoor units.

As such, a system including a plurality of indoor units 10 and an outdoor unit 20 shared by and connected to the indoor units 10 is defined as a multi air conditioning system, and a system including an indoor unit and an outdoor unit, both connected to each other in an one-and-one manner, is defined as a single air conditioner system.

That is, a multi air conditioning system should include a plurality of indoor units 10 and an outdoor unit 20 shared by and connected to the indoor units 10 as the minimum unit. At this time the plurality of indoor units are set as a lower unit and the outdoor unit is set as an upper unit.

Although not shown in the drawings, a single air conditioner system is also applicable to the present invention. The single air conditioner system includes an indoor unit and an outdoor unit, both connected to each other in a one-to-one manner as the minimum unit. The minimum unit of single air conditioner system does is not divided into an upper unit and a lower unit. However, in the case that at least one minimum unit of the single air conditioner system is connected to a gateway over a network, wherein the gateway is set as the upper unit.

And, the indoor unit 10 provided for the air conditioner system may include, but not limited to, a ceiling mount type indoor unit, a wall mount type indoor unit, and a stand type indoor unit.

Figure 2:
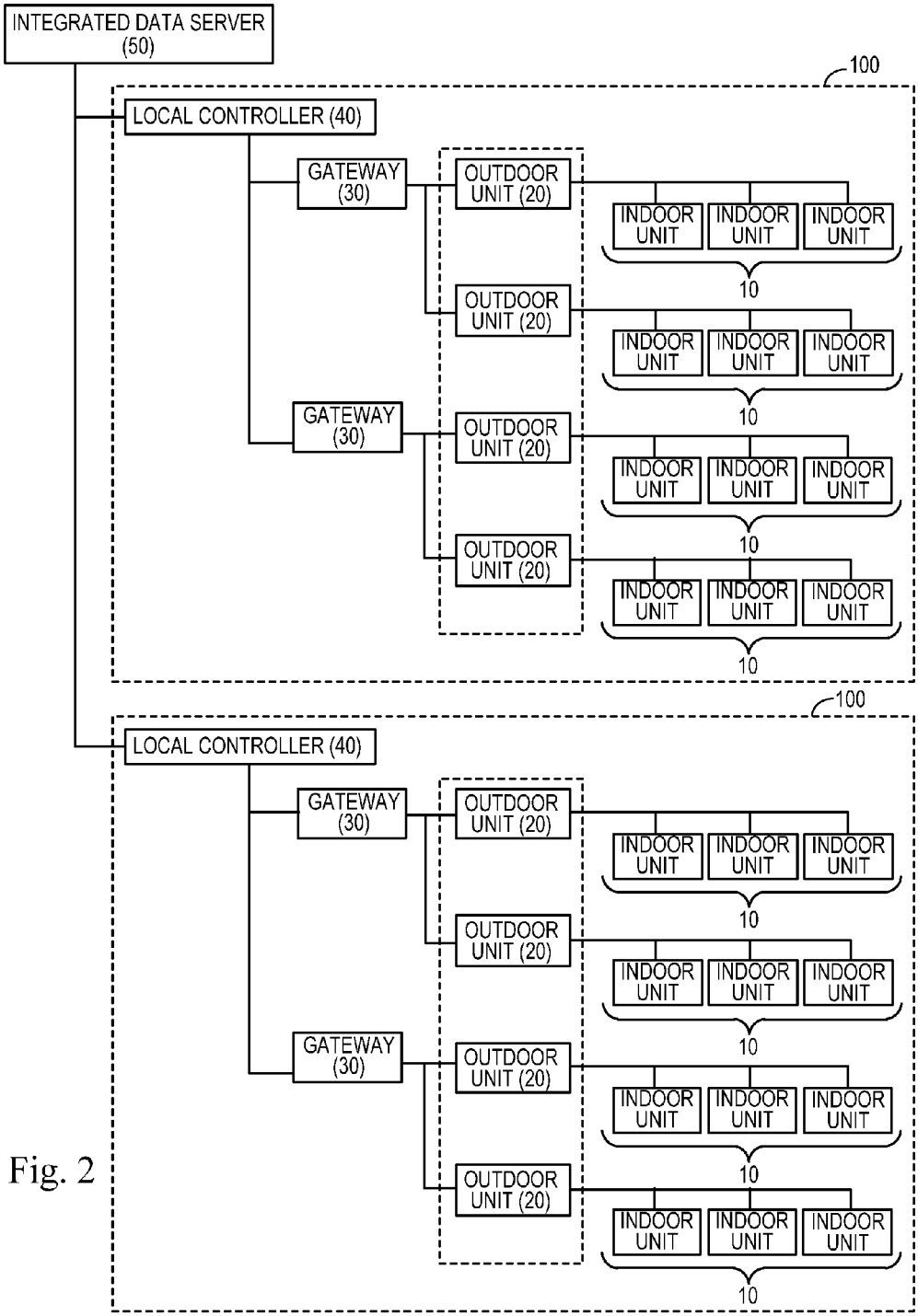
FIG. 2 is a constructional view of an air conditioner integrated management system, where an outdoor unit is designated as an upper unit.
Figure 3:
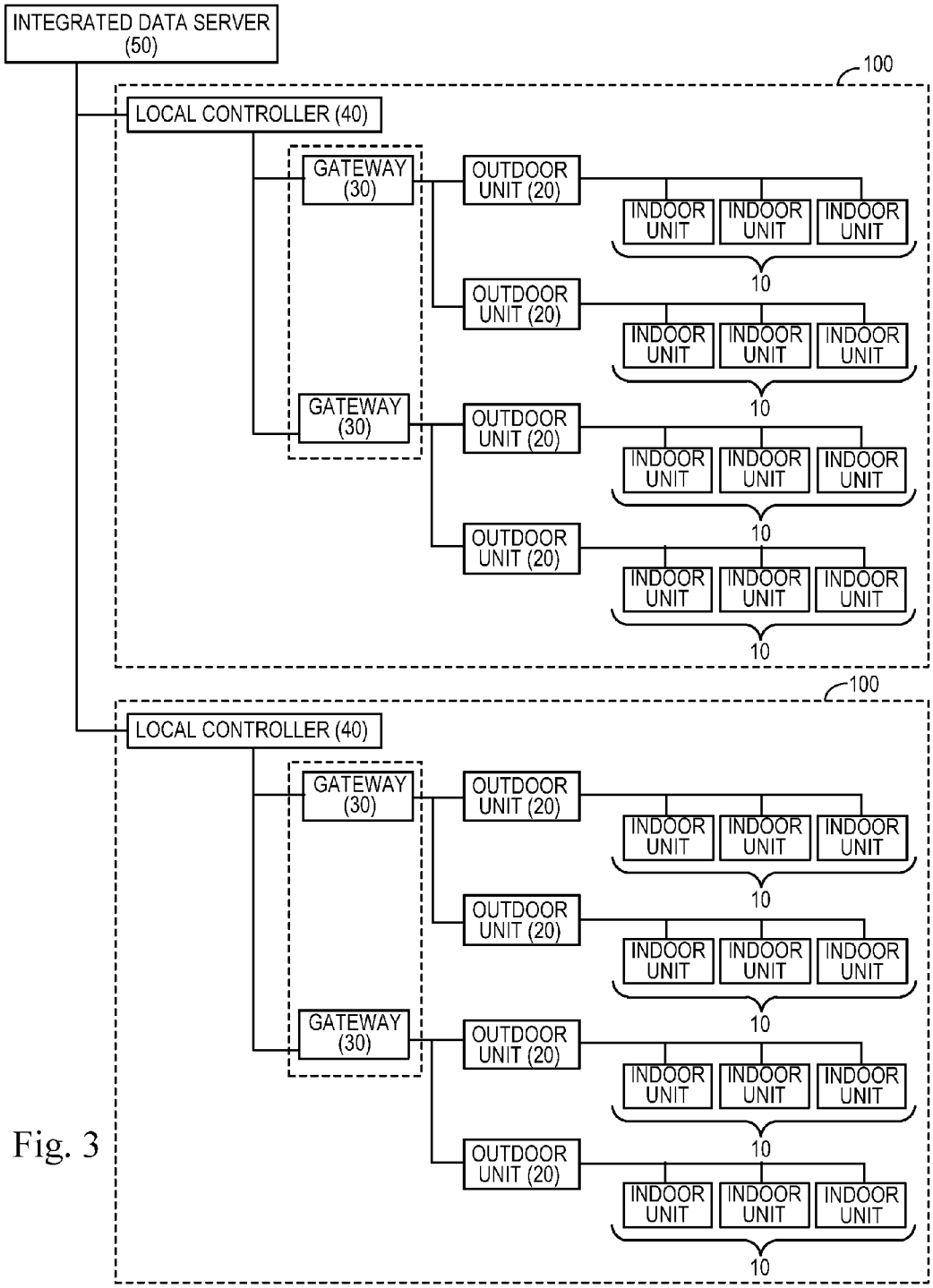
FIG. 3 is a constructional view of an air conditioner integrated management system, where a gateway is designated as an upper unit.
Figure 4:
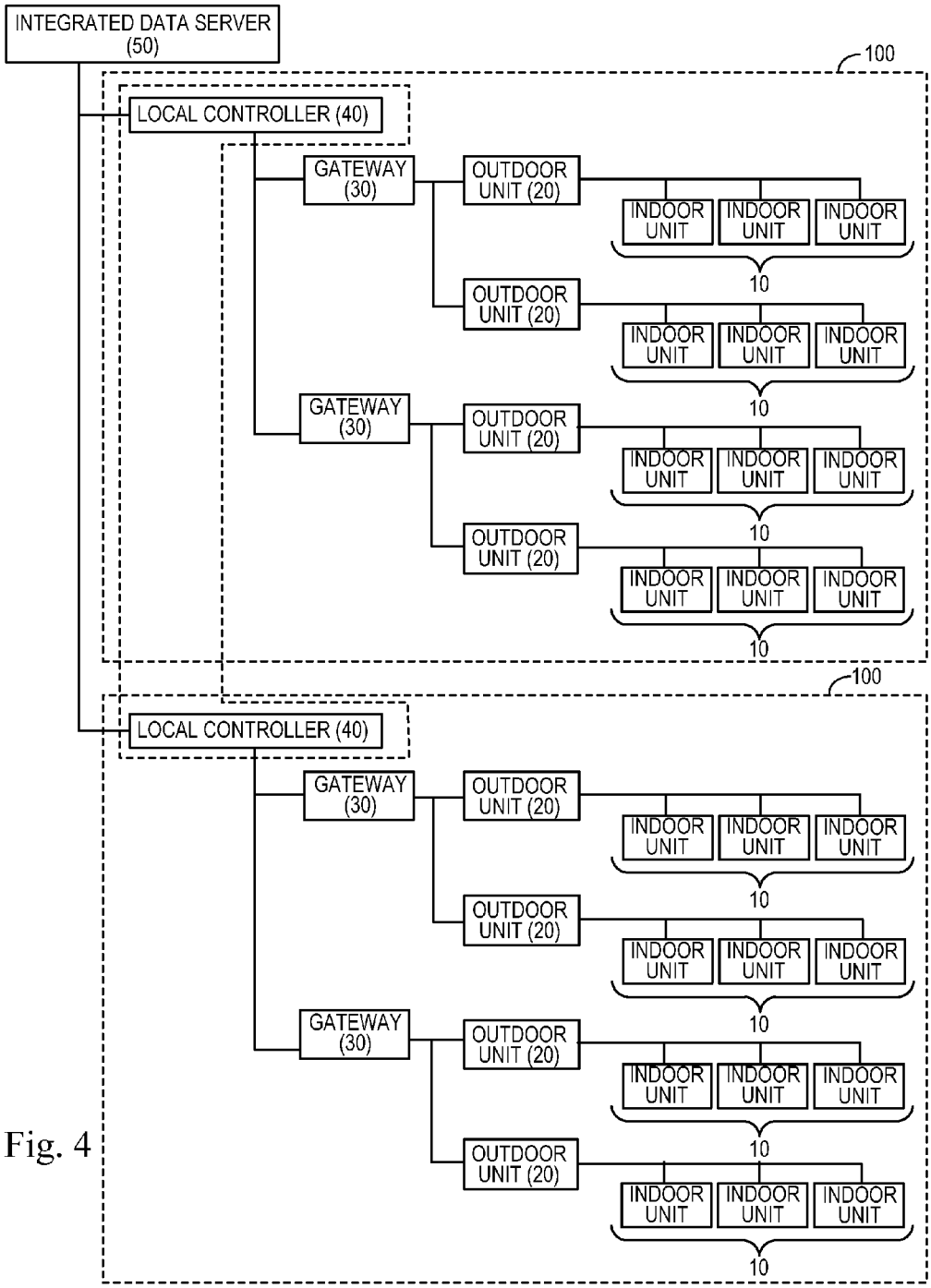
FIG. 4 is a constructional view of an air conditioner integrated management system, where a local controller is designated as an upper unit.

An air conditioning integrated management system shown in FIGS. 2 to 4 includes the minimum unit of the air conditioner system of FIG. 1. FIG. 2 is a view illustrating an air conditioning integrated management system according to a first embodiment of the present invention, where the outdoor unit 20 is set as an upper unit, FIG. 3 is a view illustrating an air conditioning integrated management system according to a second embodiment of the present invention, where the gateway 30 is set as an upper unit, and FIG. 4 is a view illustrating the air conditioning integrated management system according to a third embodiment of the present invention, where a local controller 40 is set as an upper unit.

Referring to FIGS. 2 to 4, first, the minimum unit of the indoor and outdoor units is as shown in FIG. 1, and therefore the detailed descriptions will now be omitted.

Referring to FIG. 2 illustrating the first embodiment of the present invention, the plurality of indoor units 10 are set as a lower unit, and the outdoor unit 20 connected to the indoor units 10 over a network is set as an upper unit. As an example, the indoor units and outdoor unit are connected to each other in RS-485 communication standard, which is defined as a first network.

The 'RS-485' is one of interface protocols for serial communication and a standard for multipoint communication lines, and this employs low impedance driver and receiver and allows for 32 nodes per line. In addition, the 'RS-435' enables data transmission maximally up to 1200 m, although the transmission distance may be varied depending on transmission speed.

The plurality of outdoor units 20 are shared by and connected to the gateway 30 which carries out data communication with the outdoor units connected through the first network and relays the data communication with prescribed devices connected to a second network different from the first network. For this purpose, the gateway converts one communication protocol to another communication protocol.

A local controller 40 based on the second network performs data communication with the outdoor units through the gateway 30. At this time, the second network is set to be Ethernet communication protocol, as an example.

Ethernet means a local network, i.e. LAN(Local Access Network) that can exchange information in the transmission speed of 10 Mbps between multi-points, whose number maximally amounts to 1024, approximately within 2.5 km, and uses TCP/IP as its protocol.

The local controller 40 is a device that can control the indoor units 10 set as a low unit, the outdoor unit 20, and the gateway 30, respectively, and this enables centralized control/management, thus being capable of enhancing the management efficiency.

As such, a structure including the local controller 40, the gateways 30 as the low unit of the local controller 40, the outdoor units 20 as the low unit of the gateways 30, and the indoor units 10 as the low unit of the outdoor units 20 is defined as a local air conditioner group 100.

In addition, the local controller 40 is connected to a topmost unit over an external network such as the Internet, and at this time, the topmost unit is an integrated data server 50.

That is, the local controller 40 included in the local air conditioner system 100 is connected to the integrated data server 50 over the external network to transmit system information collected from the lower unit to the integrated data server.

More specifically with respect to the construction of the local controller 40, although not shown, the local controller 40 is connected through the gateways 30 to the outdoor units 20 and includes a network connection unit to transmit and receive data to/from the remote topmost unit 50.

In addition, the local controller 40 has an input unit such as a touch screen and an output unit such as a screen mounted on its exterior so that an administrator can monitor the state of the subordinate lower units such as the gateways 30, the outdoor units 20, and the indoor units 10. The local controller 40 may include a storage storing the system information regarding the lower units and a list of inputted control commands.

The storage may include DRAM and flash memory; DRAM, a main memory of large scale integrated circuits used widely, has simple inner structure, high memory density, and reasonable price. This DRAM stores a control program driven by the central controller and various application programs.

Flash memory, a storage that can erase data stored therein by applying electrical process, is used to store and read changed data. For example, the flash memory can store data downloaded from the integrated data server connected thereto through the local controller, data for application programs managing the administrator's unique information, and so forth.

And, the local controller 40 includes a control unit which drives a software processing the control command inputted from the input unit, enables processing result data of the lower unit according to the control command, the system information, and error state information to be stored and outputted to the outside, and controls the connection over the network.

In the first embodiment, the plurality of indoor units 10 are set as the lower unit and the outdoor units 20, indicated with dashed lines, are set as the upper unit. If an error occurs in at least one of the indoor units constituting the lower unit, then the outdoor unit senses this error, generates an error list, and transfers the error list to the local controller 40 or integrated data server 50. Accordingly, error state information regarding the indoor unit determined by the outdoor unit to have caused the error is transferred to the administrator.

If all the indoor units constituting the lower unit caused the error, however, the outdoor unit determines that the outdoor unit itself raised the error and records the corresponding outdoor unit on the error list rather than records the whole indoor units on the error list. Accordingly, error state information regarding the outdoor unit determined to have caused the error is transferred to the administrator, and the administrator can promptly repair the outdoor unit considered to have raised a malfunction without the need to check up the plurality of indoor units under normal operation.

Similarly, in the second embodiment of FIG. 3, where the plurality of outdoor units 20 and indoor units 10 are set as the lower unit and the gateways 30, indicated with dashed lines, are set as the upper unit, if an error occurs in at least one of the indoor units or outdoor units constituting the lower unit, then the gateway senses this error, generates an error list, and transfers the error list to the local controller 40 or integrated data server 50. Accordingly, error state information regarding the outdoor unit or indoor unit determined to have caused the error is transferred to the administrator.

If all the outdoor units constituting the lower unit caused the error, however, the gateway determines that the gateway itself raised the error and records the corresponding gateway on the error list rather than records the whole outdoor units on the error list. Accordingly, error state information regarding the gateway determined to have caused the error is transferred to the administrator, and the administrator can promptly repair the gateway considered to have raised a malfunction without the need to check up the plurality of outdoor units and the subordinate indoor units under normal operation.

In the third embodiment of FIG. 4, where the plurality of gateways 30, outdoor units 20 and indoor units 10 are set as the lower unit and the local controllers 40, indicated with dashed lines, are set as the upper unit, if an error occurs in at least any one of the gateways, the indoor units or outdoor units constituting the lower unit, then the local controller senses this error, generates an error list, and transfers the error list to the integrated data server. Accordingly, error state information regarding the gateway, outdoor unit, or indoor unit determined to have caused the error is transferred to the administrator.

If all the gateways constituting the lower unit caused the error, however, the local controller determines that the local controller itself raised the error and records the corresponding local controller on the error list rather than records the whole gateways on the error list. Accordingly, error state information regarding the local controller determined to have caused the error is transferred to the administrator, and the administrator can promptly repair the local controller considered to have raised a malfunction without the need to check up the plurality of gateways, and the subordinate outdoor units and indoor units under normal operation.

Figure 5:
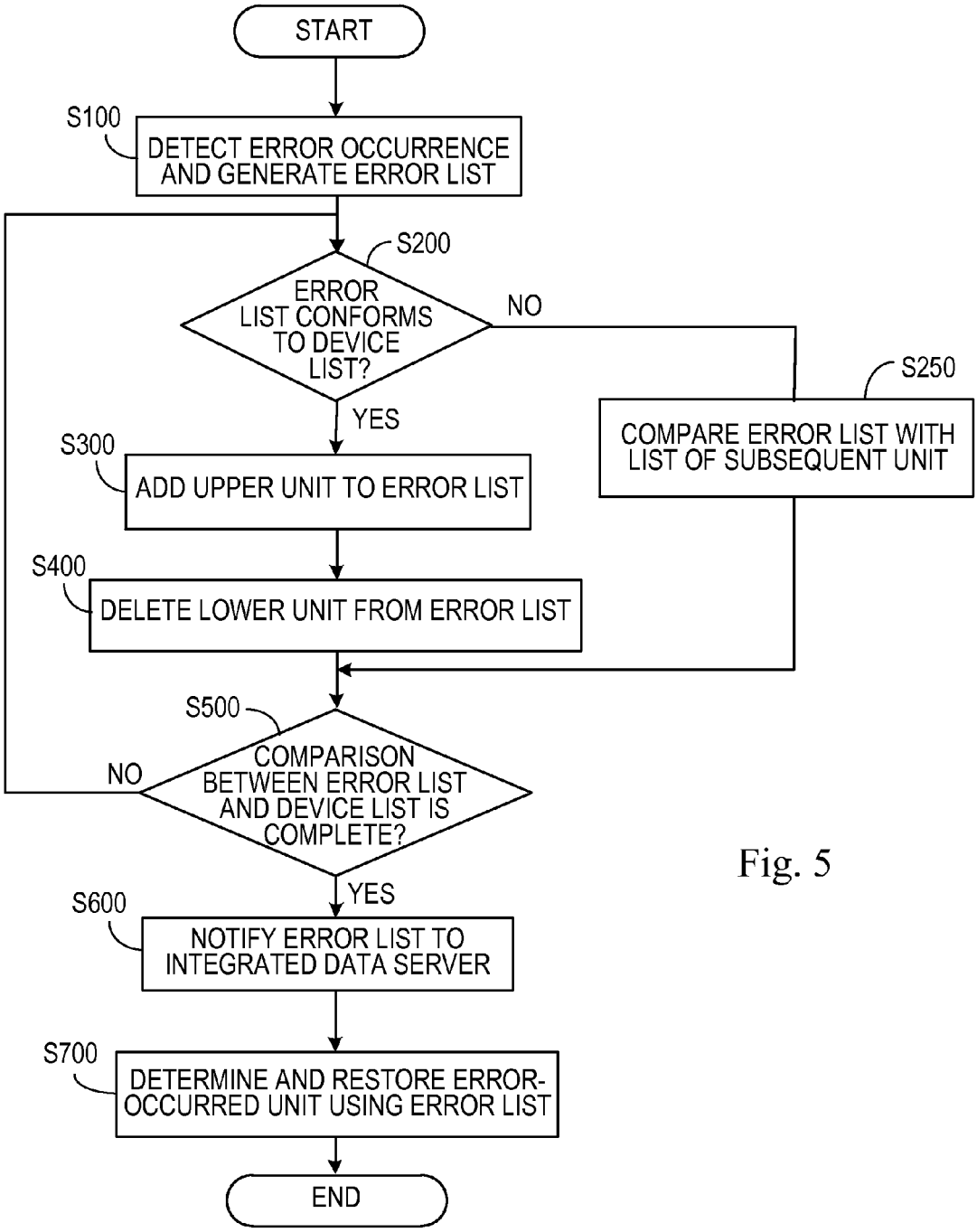
FIG. 5 is a flow chart illustrating an operational method of an air conditioner integrated management system according to the present invention.

An operational method of an air conditioner integrated management system including a lower unit including at least one indoor unit, an upper unit connected to the lower unit to perform the operation control, and a topmost unit connected to the upper unit over a network to perform the integrated control, will now be described with reference to FIG. 5.

Firstly, an error occurred at the lower unit is detected, error state information of a log data type is collected, and an error list including the lower unit where the error occurred is generated (S100). However, in a case where all the devices belonging to the lower unit are recorded on the error list, it is determined that the error occurred at the upper unit connected to the lower unit. For this purpose, it is determined whether the error list conforms to the device list of all the devices belonging to the lower unit (S200).

If the error list is determined to conform to the device list, then the upper unit managing the lower unit is added to the error list (S300) and deletes the whole devices recorded on the error list from the error list (S400).

If the error list is not determined to conform to the device list, it is determined that the error occurred only at the devices recorded on the error list (S250).

If the comparison operation between the error list and the device list is complete (S500), then the error list ends to be generated and is notified to the topmost unit, i.e. the integrated data server (S600).

Then, the administrator checks and repairs the device where the error occurred according to what has been recorded on the error list (S800).

As such, the air conditioner integrated management system and the operational method of the same according to the present invention, can sense not only an error of the subordinate lower unit but also an error of the upper unit managing the lower unit, which enables the administrator to promptly handle the error, thus being capable of reducing costs and time required to manage the air conditioning system.

The air conditioner integrated management system and the control method of the same according to the present invention, are not limited to the embodiment disclosed in the detailed description and drawings, but various applications can be made within the scope of the present invention.

What is claimed is:

1. A method of operating an air conditioner integrated management system, the method comprising:

accessing, at a shared unit, information related to an error state of one or more of multiple air conditioning units connected to the shared unit, the shared unit including at least one outdoor unit connected to at least two indoor units;

determining, from the accessed information, whether the error state is exhibited by all of the air conditioning units connected to the shared unit;

when the determination is that the error state is exhibited by all of the air conditioning units connected to the shared unit:

determining an error state of the shared unit, and removing all of the air conditioning units connected to the shared unit from registration on an error list and adding the shared unit to the error list; and transmitting error state information from the shared unit to a network connected unit.

2. The method of claim 1, wherein the shared unit includes a gateway connected to two or more outdoor units over a network.

3. The method of claim 2, wherein the shared unit includes a local controller connected to the gateway over the network.

4. The method of claim 1, wherein the network connected unit is an integrated data server connected to the shared unit over a network.

5. A method of operating an air conditioner integrated management system, the method comprising:

detecting, at an upper unit of a multiple air conditioning system, an error at a lower unit of the multiple air conditioning system, the lower unit including multiple constituent units;

determining whether all of the units included in the lower unit have been determined as causing the detected error or whether a subset of the units included in the lower unit have been determined as causing the detected error;

based on a determination that all of the units included in the lower unit have been determined as causing the detected error, determining that the upper unit caused the detected error and transmitting, to a network connected unit, error information indicating that the upper unit caused an error; and based on a determination that the subset of the units included in the lower unit have been determined as causing the detected error, determining that the subset of the units caused the detected error and transmitting, to the network connected unit, error information indicating that the subset of the units caused an error.

6. The method of claim 5, wherein the lower unit includes at least two indoor units and the upper unit includes an outdoor unit.

7. The method of claim 5, wherein the lower unit includes at least two indoor units and at least two outdoor units and the upper unit includes a gateway connected to the at least two outdoor units and configured to communicate with the at least two outdoor units.

8. The method of claim 5, wherein the lower unit includes at least two indoor units, at least two outdoor units, and at least two gateways and the upper unit includes a local controller, the at least two gateways being connected to the at least two outdoor units and the local controller being connected to the at least two gateways and configured to communicate with the at least two outdoor units via the at least two gateways.

9. The method of claim 5, wherein:

determining that the upper unit caused the detected error and transmitting, to the network connected unit, error information indicating that the upper unit caused an error includes recording that the upper unit caused the detected error on an error list and transmitting the error list to the network connected unit; and determining that the subset of the units caused the detected error and transmitting, to the network connected unit, error information indicating that the subset of the units caused an error includes recording that the subset of the units caused the detected error and transmitting the error list to the network connected unit.

10. The method of claim 5, wherein determining whether all of the units included in the lower unit have been determined as causing the detected error or whether a subset of the units included in the lower unit have been determined as causing the detected error includes comparing the detected error at the lower unit to a list of all units included in the lower unit.

* * * * *